US007559741B2

(12) United States Patent
Reichert et al.

(10) Patent No.: US 7,559,741 B2
(45) Date of Patent: Jul. 14, 2009

(54) TURBOMACHINE HAVING AN AXIALLY DISPLACEABLE ROTOR

(75) Inventors: Arnd Reichert, Mülheim an der Ruhr (DE); Bernd Stöcker, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 396 days.

(21) Appl. No.: 10/586,795

(22) PCT Filed: Jan. 19, 2005

(86) PCT No.: PCT/EP2005/000498

§ 371 (c)(1),
(2), (4) Date: Jul. 20, 2006

(87) PCT Pub. No.: WO2005/071229

PCT Pub. Date: Aug. 4, 2005

(65) Prior Publication Data

US 2008/0232949 A1 Sep. 25, 2008

(30) Foreign Application Priority Data

Jan. 22, 2004 (EP) ..... 04001335

(51) Int. Cl.
*F01D 11/18* (2006.01)

(52) U.S. Cl. ..... 415/173.1; 415/199.5; 415/220; 416/201 R

(58) Field of Classification Search ..... 415/173.1, 415/131, 199.5, 220, 221, 222, 219.1; 416/201 R
See application file for complete search history.

(56) References Cited

U.S. PATENT DOCUMENTS

| | | | | |
|---|---|---|---|---|
| 3,775,023 | A * | 11/1973 | Davis et al. | 415/199.5 |
| 4,371,311 | A * | 2/1983 | Walsh | 415/220 |
| 4,606,699 | A * | 8/1986 | Hemsworth | 415/173.1 |
| 5,056,986 | A | 10/1991 | Silvestri, Jr. et al. | |
| 2002/0009361 | A1 * | 1/2002 | Reichert et al. | 415/110 |
| 2003/0223863 | A1 | 12/2003 | Laurello et al. | |

FOREIGN PATENT DOCUMENTS

| | | |
|---|---|---|
| WO | WO 00/28190 A1 | 5/2000 |

* cited by examiner

*Primary Examiner*—Ninh H Nguyen

(57) ABSTRACT

The invention relates to a compressor, which is axially flowed through, for a gas turbine having an axially displaceable rotor. An annular flow channel, which narrows in an axial direction, is formed between a rotationally fixed outer delimiting surface and an inner delimiting surface on the rotor. A stationary ring comprised of guide profiles and at least one ring comprised of moving profiles attached to the rotor are placed inside said annular flow channel. The end of each moving or guide blade is located opposite an axial section of one of both delimiting surfaces while forming a radial gap. The aim of the invention is to provide a non-positive-displacement machine having an axially displaceable rotor whose velocity losses are at least not increased during an axial displacement of the rotor. To this end, the invention provides that the size of the radial gap between the end of each moving or guide blade and the opposite axial section of the delimiting surface is constant at least over the path of displacement of the rotor, and the radial gap extends parallel to the rotation axis of the rotor.

10 Claims, 3 Drawing Sheets

TURBOMACHINE HAVING AN AXIALLY DISPLACEABLE ROTOR

CROSS REFERENCE TO RELATED APPLICATIONS

This application is the US National Stage of International Application No. PCT/EP2005/000498 filed Jan. 19, 2005 and claims the benefits thereof. The International Application claims the benefits of European application No. EP04001335.1 filed Jan. 22, 2004, both of the applications are incorporated by reference herein in their entirety.

FIELD OF THE INVENTION

The invention relates to a turbomachine, in particular an axial-flow compressor for a gas turbine.

BACKGROUND OF THE INVENTION

Gas turbines coupled to generators are used for converting fossil energy into electrical energy. To this end, a gas turbine has a compressor, a combustion chamber and a turbine unit along its rotor shaft. During operation of the gas turbine, the compressor draws in ambient air and compresses it. The compressed air is then mixed with a fuel and fed to the combustion chamber. There, the gas burns to form a hot working medium and then flows into the turbine unit, in which blades are provided. In the process, the guide blades fastened to the casing of the turbine unit guide the working medium onto the moving blades fastened to the rotor, so that said moving blades set the rotor in a rotary movement. The rotational energy thus absorbed is then converted into electrical energy by the generator coupled to the rotor. Furthermore, it is used for driving the compressor.

WO 00/28190 discloses a gas turbine having a compressor, the rotor of which is displaced against the direction of flow of the working medium in order to set the radial gap which is formed between the tips of the turbine moving blades and the inner casing. In the process, the radial gaps of the turbine unit are reduced, which leads to a substantial reduction in the flow losses in the turbine unit and therefore to an increase in the efficiency of the gas turbine. At the same time, the radial gaps in the compressor are increased, which increases the flow losses in the compressor. Despite the losses in the compressor, the displacement of the rotor leads to an increase in the output of the gas turbine.

Furthermore, U.S. Pat. No. 5,056,986 discloses a gas turbine having a compressor in which rings of guide blades and moving blades are alternately arranged one behind the other. The guide blades are secured on the tip side in a fastening ring enclosing the rotor, and the moving blades are each provided with shroud bands which form a shroud-band ring on the tip side, this shroud-band ring being opposite the casing, with a radial gap being formed. In this case, the radial gaps run parallel to the rotation axis.

SUMMARY OF THE INVENTION

The object of the present invention is to specify a turbomachine having an axially displaceable rotor, the flow losses of which are at least not increased during an axial displacement of the rotor.

This object is achieved by the features of the independent claim. Advantageous configurations are specified in the subclaims.

The solution of the object makes provision for the size of each radial gap between the end of each exposed moving or guide blade and the opposite axial section of the boundary surface to be constant at least over the displacement distance of the rotor, and for the radial gap to run parallel to the rotation axis of the rotor. The solution in this case is based on the knowledge that the flow losses during a displacement of the rotor are not increased if the radial gap between fixed and rotating components remains constant over the displacement distance of the rotor. To this end, in the flow duct, components forming the radial gap, such as the end of a moving or guide blade and the boundary or guide surface opposite it, are formed parallel to the rotation axis of the rotor. During a displacement of the rotor in the axial direction, the size of each radial gap therefore remains constant. This is advantageous in particular for a flow duct of a compressor of a gas turbine.

The previous restriction in which the axial contour shape, formed by the inner and outer guide surfaces, of a flow duct was designed and formed according to purely aerodynamic requirements has therefore been averted. The flow duct according to the invention has now been designed in accordance with the new requirement—the displaceability of the rotor when using exposed blading.

In an advantageous development, the outer guide surface for the flow medium is formed at least partly by the top side of the platforms of the guide blades, this top side facing the guide profile. This ensures that the flow medium is guided by the platforms of the guide blades.

In a further configuration, the inner guide surface is formed at least partly by the top side of the platforms of the moving blades, this top side facing the moving profile. The flow medium is therefore guided by the inner guide surface.

If the top sides of the platforms of the moving and guide blades, respectively, are inclined in the axial direction relative to the displacement direction, the requisite narrowing of the flow duct in the axial direction at the fixed ends of the moving and guide blades, respectively, is thus effected. There is no radial gap at this location, the size of which would change on account of the displacement of the rotor.

An advantageous measure proposes that, in the axial sections in which guide profiles are arranged, the inner guide surface run cylindrically and the outer guide surface run inclined, in particular conically, relative to the rotation axis. For the section considered, i.e. for the guide-blade ring, the change in the cross section of flow of the flow duct, which change is necessary for the turbomachine, is therefore effected in each case only on that boundary side of the flow duct at which no radial gaps exist.

The same applies to the advantageous configuration of a moving-blade ring, in which, in the axial sections in which moving profiles are arranged, the outer guide surface runs cylindrically and the inner guide surface runs inclined, in particular conically, relative to the rotation axis. In this case, the expression "an inclined guide surface" refers to the fact that the guide surface deviating from the cylindrical shape forms the cross section of the flow duct in a diverging or converging manner in the axial direction.

The alternating arrangement of the above-designed guide-blade rings and moving-blade rings in a row is especially preferred, so that both the inner and the outer guide surface in each case have a "wavelike" contour shape in the axial direction, i.e. inclined and cylindrical contours of the guide surfaces alternate in the axial direction, in each case an inclined contour being located opposite inside a section of a cylindrical contour, and vice versa. This leads to a respective alternating change in the inner and outer guide surfaces of the flow duct. In particular, this configuration avoids the purely aerodynamic design of the flow duct.

Especially advantageous is the configuration in which the outer guide surface and that section of the outer guide surface which extends in the axial direction and which is opposite the ends of the moving blade of a moving-blade ring are formed by means of a guide ring. A simple and cost-effective configuration is therefore possible.

In an especially advantageous manner, the turbomachine is designed as an axial-flow compressor of a gas turbine. The axial displacement of the rotor against the direction of flow of the flow medium leads in the turbine unit to radial gaps which become smaller and increase the efficiency, whereas the radial gaps in the compressor remain constant. Flow losses in the compressor are therefore kept constant despite the displacement of the common rotor. In general, this leads to a further increase in the power output, compared with that of the prior art.

BRIEF DESCRIPTION OF THE DRAWINGS

The invention is explained with reference to drawings, in which.

DETAILED DESCRIPTION OF THE INVENTION

Figure 1:
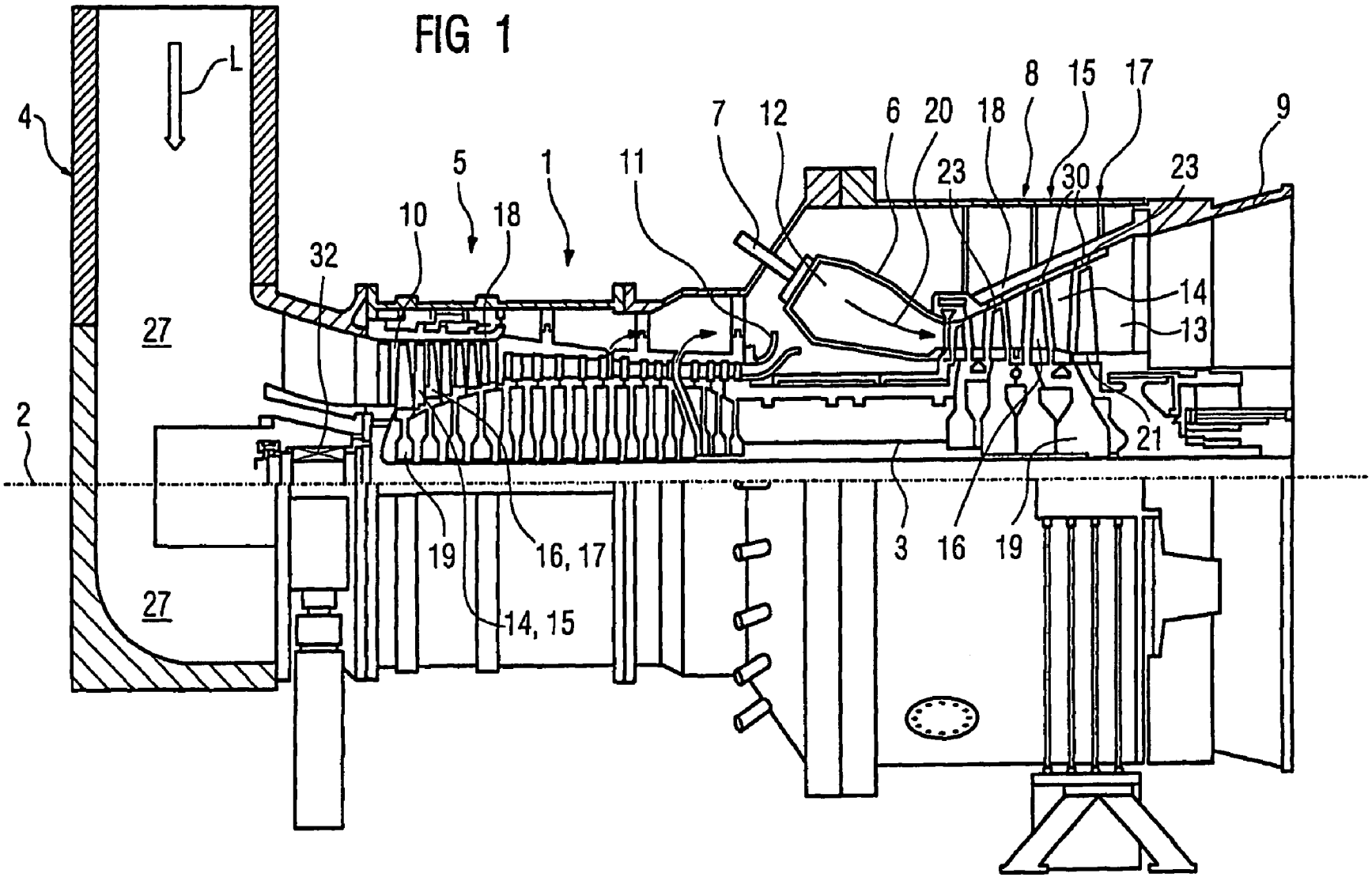
FIG. 1 shows a gas turbine in a longitudinal partial section.

FIG. 1 shows a gas turbine 1 in a longitudinal partial section. In the interior, it has a rotor 3 which is rotatably mounted about a rotation axis 2 and is also referred to as turbine rotor or rotor shaft. Following one another along the rotor 3 are an intake casing 4, a compressor 5, a torus-like annular combustion chamber 6 having a plurality of coaxially arranged burners 7, a turbine unit 8 and the exhaust-gas casing 9.

Provided in the compressor 5 is an annular compressor duct 10 which narrows in cross section in the direction of the annular combustion chamber 6. Arranged at the combustion-chamber-side outlet of the compressor 5 is a diffuser 11, which is fluidically connected to the annular combustion chamber 6. The annular combustion chamber 6 forms a combustion space 12 for a mixture of fuel and compressed air. A hot-gas duct 13 arranged in the turbine unit 8 is fluidically connected to the combustion space 12, the exhaust-gas casing 9 being arranged downstream of the hot-gas duct 13.

Respective blade rings are arranged in the compressor duct 10 and in the hot-gas duct 13. In each case a moving-blade ring 17 formed from moving blades 16 alternately follows a guide-blade ring 15 formed from guide blades 14. The fixed guide blades 14 are in this case connected to one or more guide-blade carriers 18, whereas the moving blades 16 are fastened to the rotor 3 by means of a disc 19.

The turbine unit 8 has a conically widening hot-gas duct 13, the outer guide surface 21 of which widens concentrically in the direction of flow of the working fluid 20. The inner guide surface 22, on the other hand, is oriented essentially parallel to the rotation axis 2 of the rotor 3. At their free ends, the moving blades 16 have grazing edges 29, which form a radial gap 23 with the outer guide surfaces 21 opposite them.

During operation of the gas turbine 1, air is drawn in from the compressor 5 through the intake casing 4 and is compressed in the compressor duct 10. The air L provided at the burner-side end of the compressor 5 is directed through the diffuser 11 to the burners 7 and is mixed there with a fuel. The mixture is then burned, with a working fluid 20 being formed in the combustion space 12. The working fluid 20 flows from there into the hot-gas duct 13. At the moving blades 16 arranged in the turbine unit 8, the working fluid expands in an impulse-transmitting manner, so that the rotor 3 is driven together with a driven machine (not shown) coupled to it.

An inlet-side compressor bearing 32 serves, in addition to the axial and radial mounting, as an adjusting device for a displacement of the rotor. In this case, in order to increase the output of the gas turbine 1, the rotor 3, in the steady state, is displaced, to the left in FIG. 1, from an initial position into a steady operating position against the direction of flow of the working fluid 20. As a result, the radial gap 23 formed in the turbine unit 8 by moving blades 16 and the outer guide surface 21 is reduced. This leads to a reduction in the flow losses in the turbine unit 8 and therefore to an increase in the efficiency of the gas turbine 1.

Figure 2:
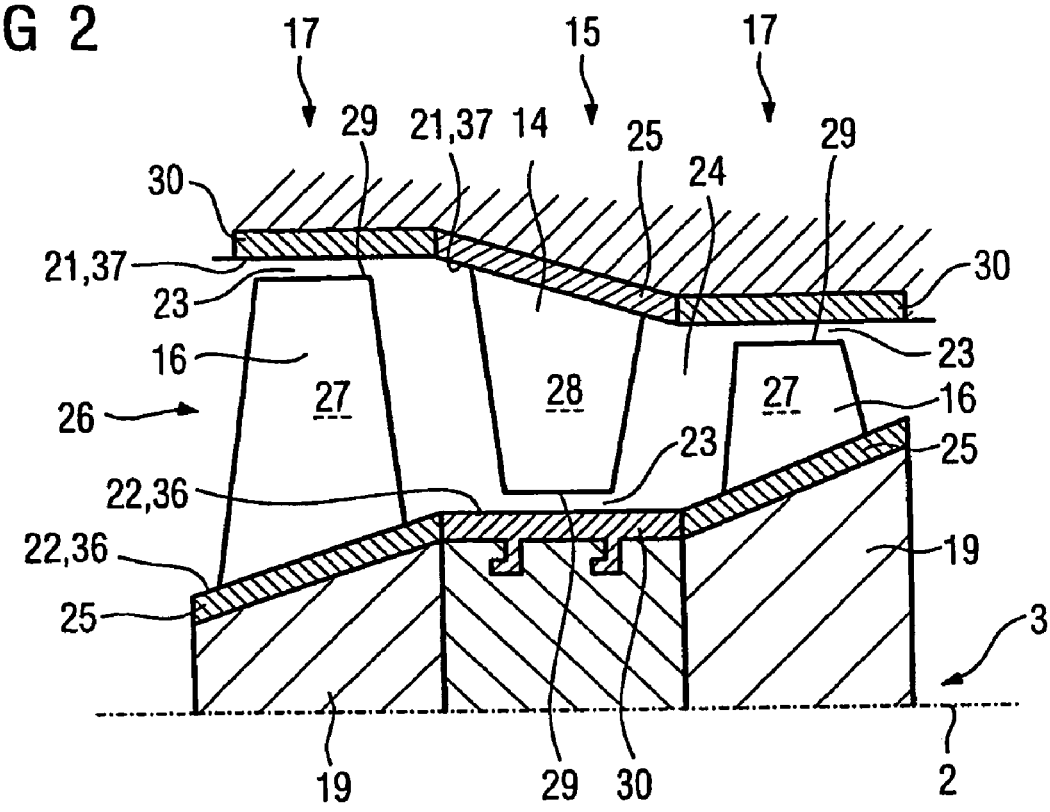
FIG. 2 shows a section of a cylindrical contour of a flow duct of a compressor.
Figure 3:
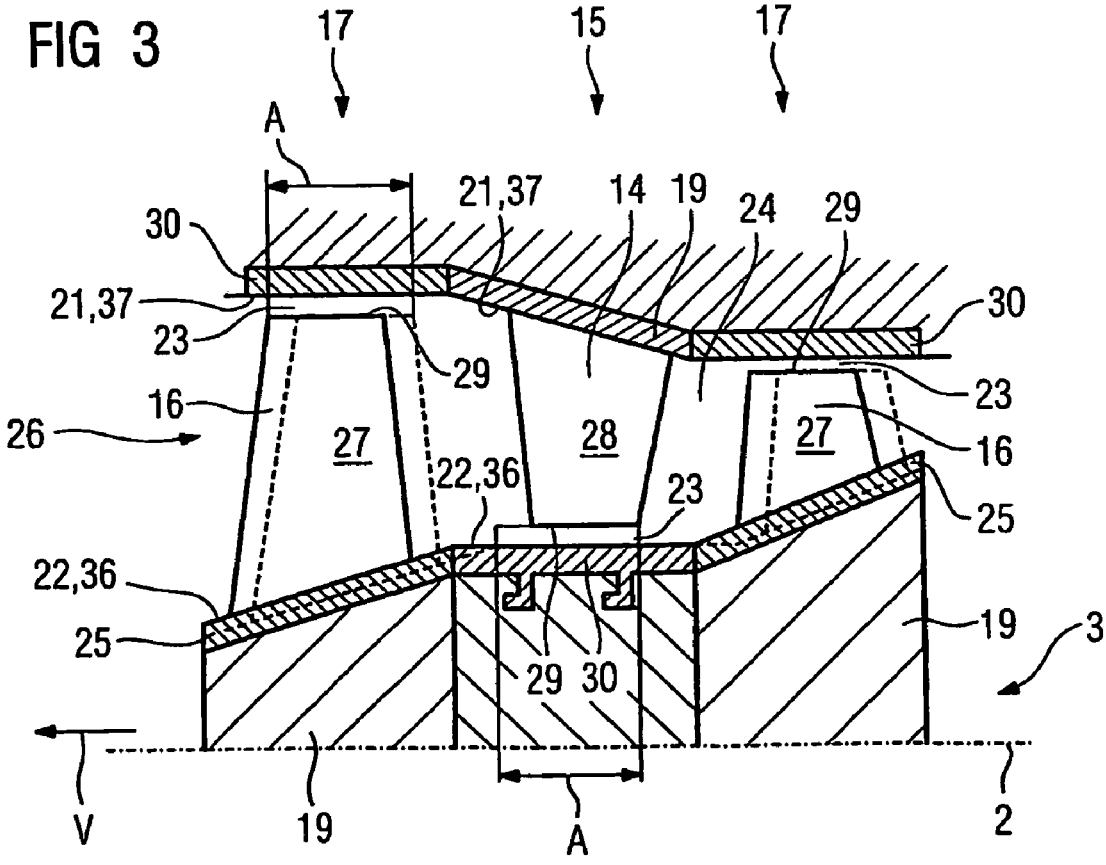
FIG. 3 shows the contour of the flow duct according to FIG. 2 with an axially displaced rotor.

A section of the annular duct of the compressor 5 with two moving-blade rings 17 and with a guide-blade ring 15 arranged in between is shown in FIG. 2. The annular duct is in this case designed as a flow duct 24 for air as the flow medium 26. In FIG. 2 and FIG. 3, the outer guide surface 21 is identical to the outer boundary surface 37 and the inner guide surface 22 is identical to the inner boundary surface 36.

In FIG. 2, the rotor 3 is in its initial position. The guide blades 14 and the guide-blade ring 15 are fastened to an external wall, whereas the moving blades 16 are arranged on the rotor 3 of the compressor 5. At its fixed end, each moving blade 16 has a respective platform 25, the surfaces of which define the compressor duct 10 on the inside. Likewise, each guide blade 14, at its fixed end, has a platform 25, which defines the compressor duct 10 on the outside. Extending from the platform 25 of the moving blade 16 (or of the guide blade 14) into the compressor duct 10 is a moving profile 27 (or respectively a guide profile 28) which compresses the air L during operation of the compressor 5. The free ends of the moving and guide profiles 27, 28, respectively, which free ends are opposite the platform-side ends, are designed as grazing edges 29 and are opposite respective guide rings 30, with the radial gap 23 being formed.

As viewed in the axial direction, the radial gap 23 is in each case oriented parallel to the rotation axis 2 in one section, i.e. the axial length of a blade ring including a displacement distance V explained later, i.e. the guide ring 30 and the grazing edge 29 extend cylindrically relative to the rotation axis 2. On the other hand, the platforms 25 arranged in the section are each inclined relative to the rotation axis 2 of the rotor 3, so that the flow duct 24 narrows as viewed in the axial direction. A cylindrical contour of the flow duct 24 is obtained in the regions of the radially opposite fixed and rotating components, which as viewed in the axial direction lie in sections and in the radial direction lie inside and respectively outside the guide profiles and moving profiles, respectively. In the axial direction, therefore, both the outer guide surface 21 and the inner guide surface 22 alternately run cylindrically and in such a way as to be inclined relative to the rotation axis 2 of the rotor 3, the cylindrical guide surface 21, 22 in each case being opposite an inclined guide surface 21, 22 as viewed in the radial direction of the rotor 3.

In FIG. 3, the rotor 3 is displaced into its steady operating position relative to the rotationally fixed components of the gas turbine 1 against the direction of flow of the flow medium 26. For comparison, its initial position is indicated in broken lines. Despite the displacement of the rotor 3, the size of the radial gap 23 remains constant, so that the flow losses in the compressor 5 are not increased. To this end, the guide ring 30 and the grazing edge 29 are formed parallel to the rotation axis 2 of the rotor over the axial length of a section A. In this case, the section A is composed of the axial length of the grazing edges 29 and the axial displacement distance V. Compared with the solution in the prior art, the novel solution leads to a further increase in the output of the gas turbine 1, since the losses arising in the compressor 5 have remained constant with the displacement of the rotor 3.

Figure 4:
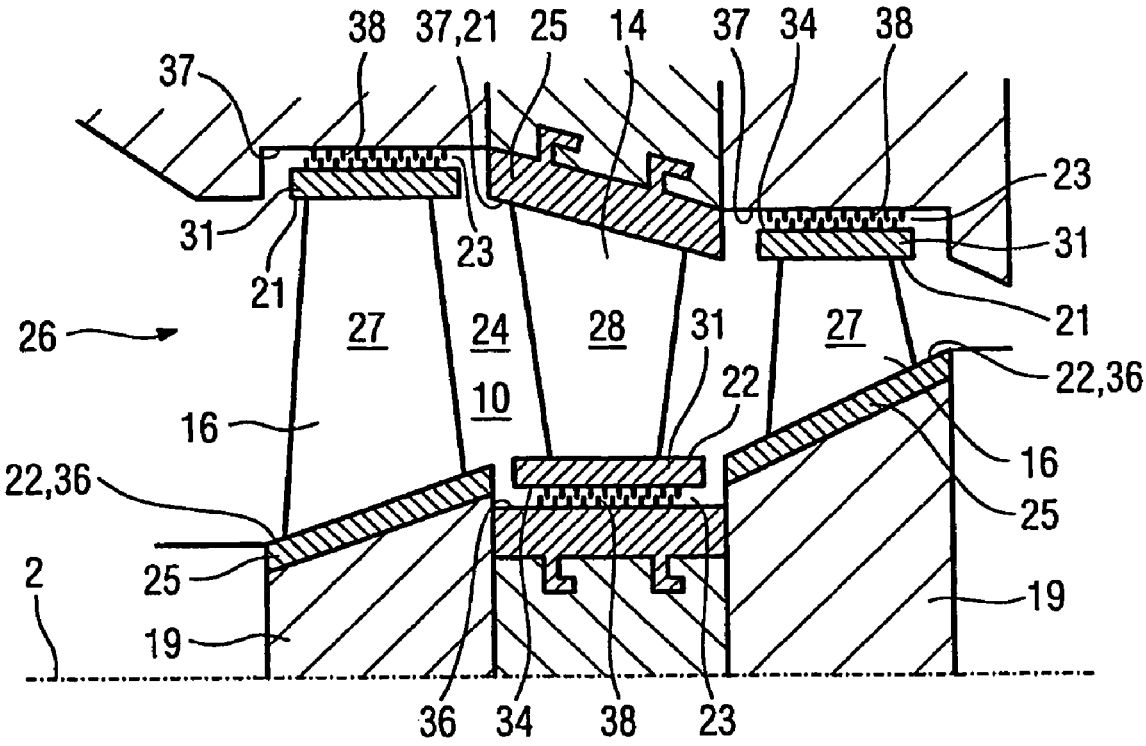
FIG. 4 shows the contour of a flow duct of a further compressor.

FIG. 4 shows a detail of the flow duct 26 of the compressor 3 in which each guide blade 14 has a respective second platform 31 at its end facing the rotor 3. In this case, the further platforms 31 of the guide blades 14 of the guide-blade ring 15 form a ring enclosing the rotor 3. Those surfaces of the further platforms 31 which face the guide profile 28 form the inner guide surface 22 for the flow medium 26. A rear side 34, facing away from the guide surfaces 22, of the platform 31 is opposite a boundary surface 36. The radial gap 23 running parallel to the rotation axis 2 is formed between the rear side 34 of the platform 31 and the boundary surface 36.

The moving blades 16 are fastened to the discs 19 of the rotor 3. In this case, between the running profile 27 and the disc 19, the moving blades 16 have platforms 25, the surfaces of which face the moving profile 27. They are designed as inner guide surfaces 22 and at the same time as boundary surfaces 36 for the compressor duct 10 and define the flow duct 24. At their free ends, each moving profile 27 has further platforms 31, whose surface facing the moving profile 27 form, as inner guide surfaces 22, the flow duct 24. On their rear side 34 opposite the guide surface 21, 22, the further platforms 31 have a respective circumferential surface which is opposite the boundary surface 36 of the annular duct 10. As a result, the radial gap 23 is formed here between the inner boundary surface 36 and the inner guide surface 22, this radial gap, as viewed in the axial direction, running parallel to the rotation axis 2 of the rotor 3. Arranged in the radial gap 23 is a respective labyrinth seal 38 which prevents the flow losses in the flow medium 26.

If further platforms 31 are provided at the ends of the guide blades 14 and moving blades 16, respectively, the guide surfaces 21, 22 no longer need to be formed cylindrically relative to the rotation axis 2, since they do not define the radial gap 23. Only the rear side 34 of the further platforms 31 must be formed cylindrically here, so that the radial gap 23 remains constant during the displacement of the rotor 3.

Also conceivable is a flow duct 24 in which guide blades 14 having further platforms 31 form a guide-blade ring 15, following which is a moving-blade ring 17 having exposed moving blades 16.

The invention claimed is:

1. A turbomachine, comprising:

an axially displaceable rotor;

an annular duct between an outer guide surface fastened to an external wall and an inner guide surface arranged on the rotor;

an annular flow duct narrowing in an axial direction and formed by a working medium flowing through the annular duct;

a guide-blade ring formed from a guide blade having a guide profile extending between a platform of the guide blade arranged in the annular duct and an end of the guide blade exposed into the working medium;

a moving-blade ring formed from a moving blade having a moving profile extending between a platform of the moving blade fastened to the rotor and an end of the moving blade exposed into the working medium;

a first radial gap located in a first axial section formed between the outer guide surface and the exposed end of the moving blade; and a second radial gap located in a second axial section which is opposite to the first axial section formed between the inner guide surface and the exposed end of the guide blade, wherein the first and second radial gaps are parallel to a rotation axis of the rotor and a size of the radial gaps is constant over an axial displacement distance of the rotor, wherein a guide ring is configured by an axial section of the outer guide surface and is parallel to the rotation axis of the rotor, wherein the axial section of the outer guide surface is a sum of an axial length of the exposed end of the moving blade and the axial displacement distance of the rotor.

2. The turbomachine as claimed in claim 1, wherein the outer guide surface is formed partly by a top side of the platform of the guide blade, the top side:

facing the guide profile, and inclined in the axial direction so that the flow duct narrows in the axial direction.

3. The turbomachine as claimed in claim 1, wherein the inner guide surface is formed partly by a top side of the platform of the moving blades, the top side:

facing the moving profile, and inclined in the axial direction so that the flow duct narrows in the axial direction.

4. The turbomachine as claimed in claim 1, wherein in the first axial section the outer guide surface is cylindrical and the inner guide surface is conically inclined relative to the rotation axis, wherein in the second axial section the inner guide surface is cylindrical and the outer guide surface is conically inclined relative to the rotation axis, and wherein the first and second axial sections are arranged alternatively in the axial direction.

5. The turbomachine as claimed in claim 1, wherein the turbomachine is an axial-flow compressor of a gas turbine.

6. A method for improving a flow lose during an axial displacement of a rotor of a turbomachine, comprising:

arranging an annular duct between an outer guide surface fastened to an external wall and an inner guide surface arranged on the rotor;

providing a first radial gap located in a first axial section formed between the outer guide surface and an end of a moving blade fastened to the rotor and exposed into a working medium, the first radial gap parallel to a rotation axis of the rotor;

providing a second radial gap located in a second axial section which is opposite to the first axial section formed between the inner guide surface and an end of a guide blade arranged in the annular duct and exposed into the working medium, the second radial gap parallel to the rotation axis of the rotor; and maintaining a constant size of the first and second radial gaps over a distance of the axial displacement of the rotor, wherein a guide ring is configured by an axial section of the outer guide surface and is parallel to the rotation axis of the rotor, wherein the axial section of the outer guide surface is a sum of an axial length of the exposed end of the moving blade and the axial displacement distance of the rotor.

7. The method as claimed in claim 6, wherein the outer guide surface is formed partly by a top side of a platform of the guide blade and the top side is inclined in the axial direction so that the annular duct narrows in the axial direction.

8. The method as claimed in claim 6, wherein the inner guide surface is formed partly by a top side of a platform of the moving blade and the top side is inclined in the axial direction so that the annular duct narrows in the axial direction.

9. The method as claimed in claim 6, wherein in the first axial section the outer guide surface is cylindrical and the inner guide surface is conically inclined relative to the rotation axis, wherein in the second axial section the inner guide surface is cylindrical and the outer guide surface is conically inclined relative to the rotation axis, and wherein the first and second axial sections are arranged alternatively in the axial direction.

10. The method as claimed in claim 6, wherein the turbomachine is an axial-flow compressor of a gas turbine.

* * * * *